US010813421B2

(12) United States Patent
Lee

(10) Patent No.: US 10,813,421 B2
(45) Date of Patent: Oct. 27, 2020

(54) END CAP STRUCTURE FOR CANE/CRUTCH/TREKKING POLE

(71) Applicant: VISION SPORTS ENTERPRISE CO., LTD., Dongguan, Guangdong (CN)

(72) Inventor: Ming-Hsien Lee, Dongguan (CN)

(73) Assignee: VISION SPORTS ENTERPRISE CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/252,531

(22) Filed: Jan. 18, 2019

(65) Prior Publication Data

US 2020/0229555 A1 Jul. 23, 2020

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A45B 2200/05* (2013.01)

(58) Field of Classification Search
CPC . A45B 9/04; A45B 2200/05; A45B 2200/055; A61H 3/02; A61H 3/0288; A61H 2003/0283; A47B 91/12; A47B 91/00; A47B 91/04; A47C 7/002
USPC ..... 135/98, 16, 77, 78, 82, 86, 84; 248/188.9, 501
See application file for complete search history.

(56) References Cited

U.S. PATENT DOCUMENTS 483,931 A * 10/1892 Lanergan ..... A61H 3/0288 135/86
1,340,617 A * 5/1920 Lynde ..... A61H 3/0288 135/83
1,663,622 A * 3/1928 Atkinson ..... A45B 9/04 135/86
1,804,390 A * 5/1931 Herold ..... A47B 91/04 16/42 R
1,888,037 A * 11/1932 Herold ..... A47B 91/04 16/42 R
2,116,941 A * 5/1938 Francis ..... A61H 3/0288 135/78
4,562,851 A * 1/1986 Frank ..... A45B 9/04 135/78
4,947,882 A * 8/1990 Levasseur ..... A61H 3/0288 135/77
5,088,513 A * 2/1992 Ostermeyer ..... A61H 3/0288 135/82

(Continued)

FOREIGN PATENT DOCUMENTS

CN 204763788 U * 11/2015
CN 108523339 A * 9/2018

(Continued)

*Primary Examiner* — Robert Canfield
(74) *Attorney, Agent, or Firm* — Leong C. Lei

(57) ABSTRACT

An end cap structure for a cane/crutch/trekking pole includes a main body, an elastic interlayer, and a bottom layer. The elastic interlayer is disposed between the main body and the bottom layer to ensure the structural strength of the end cap. When the user swings the cane/crutch/trekking pole in all directions, the whole underside of the bottom layer is kept in contact with the ground due to the elastic interlayer to ensure that the anti-slip function is not affected, thereby improving the safety of the product when in use.

7 Claims, 4 Drawing Sheets

(56) References Cited

U.S. PATENT DOCUMENTS 5,178,176 A * 1/1993 Fetterman ..... A45B 9/04 135/86
5,301,704 A * 4/1994 Brown ..... A45B 9/04 135/78
5,353,825 A * 10/1994 Davis ..... A45B 9/04 135/68
5,826,606 A * 10/1998 Davenport ..... A45B 9/04 135/82
7,427,052 B2 * 9/2008 Cha ..... A47B 91/024 16/42 R
7,748,396 B2 * 7/2010 Lasota ..... A61H 3/0288 135/77
8,408,224 B2 * 4/2013 Ozuna ..... A61H 3/0288 135/65
8,851,094 B2 * 10/2014 Kuma ..... A45B 9/04 135/75
9,408,428 B2 * 8/2016 Gaudet ..... B25D 1/12
2004/0107983 A1 * 6/2004 Liao ..... A61H 3/0288 135/84
2009/0288693 A1 * 11/2009 Lasota ..... A61H 3/0288 135/86
2011/0240077 A1 * 10/2011 Doherty ..... A61H 3/02 135/71
2012/0067386 A1 * 3/2012 Giannatasio ..... A61H 3/0288 135/84
2012/0222714 A1 * 9/2012 Kuma ..... A45B 9/04 135/77
2012/0260958 A1 * 10/2012 Reitano ..... A45B 9/04 135/83
2014/0041700 A1 * 2/2014 Wu ..... A45B 9/04 135/17
2014/0209135 A1 * 7/2014 Palo ..... A61H 3/0288 135/86
2014/0373887 A1 * 12/2014 Gray ..... A45B 9/04 135/77
2015/0374082 A1 * 12/2015 Austin ..... A45B 9/04 135/77
2017/0311688 A1 * 11/2017 Chen ..... A45B 9/04

FOREIGN PATENT DOCUMENTS

CN 109439754 A * 2/2019
CN 209660652 U * 11/2019

* cited by examiner

END CAP STRUCTURE FOR CANE/CRUTCH/TREKKING POLE

BACKGROUND OF THE INVENTION

1. Field of the Invention

The present invention relates to an end cap, and more particularly to an end cap structure for a cane/crutch/trekking pole.

2. Description of the Prior Art

Walking canes, crutches and trekking poles are common walking support tools. In order to ensure the safety of walking, the bottom end of a walking cane/crutch/trekking pole is equipped with an end cap. The anti-slip design of the end cap is very important. There are various end caps in the prior art.

Chinese Utility Model Publication No. CN204763788U discloses an end cap and a crutch having the same. The crutch includes a crutch body and an end cap mounted to the lower end of the crutch body. The lower end portion of the crutch body is mounted in a receiving hole by an interference fit. The end cap comprises a support disk and a brace vertically disposed on the upper end surface of the support disk. The upper end of the brace is provided with a receiving hole extending axially along the brace for receiving the lower end portion of the crutch. The above-mentioned end cap is a one-piece structure. During the use of the walking cane/crutch/trekking pole, the user often swings the walking cane/crutch/trekking pole. As a result, the underside of the whole end cap cannot be in contact with the ground, and the anti-slip function is affected, which poses a safety hazard to the use.

Chinese Patent Application Publication No. CN108523339A discloses a nested double-layer movable end cap for a crutch. The nested double-layer movable end cap includes an inner sleeve and an outer sleeve. The inner sleeve is coupled to the crutch, and the outer sleeve is fitted on the inner sleeve. The inner sleeve and the outer sleeve are made of an elastic material. The crutch is insertedly connected to the inner sleeve. The inner sleeve has a corresponding receiving hole. The inner sleeve is provided with an annular protrusion. The protrusion is located at the lower part of the inner sleeve and is connected with the outer sleeve. The outer sleeve is provided with a corresponding reduced opening. The outer sleeve has a cylindrical or other shape. The outer sleeve is an integral sleeve and wraps the inner sleeve. When the user swings the crutch, the whole underside of the outer sleeve cannot be in contact with the ground, and the anti-slip function is affected, thereby posing a safety hazard to the use.

Chinese Utility Model Publication No. CN108523339A discloses a crutch. The crutch includes a pole member, a grip and a base. The lower part of the pole member is provided with a telescopic rod. The telescopic rod is composed of an upper rod, a lower rod and a locking head. The upper end of the upper rod is fixedly connected with a connecting sleeve. A spring, a first flange disk, a second flange disk and a damping cavity are arranged in the upper rod. A flange is arranged on an upper end of the lower rod. A first piston, a second piston and a piston rod are arranged in the damping cavity. A first cavity and a second cavity are disposed in the damping cavity. The base is composed of an upper seat, a lower seat, a flexible connecting neck, and an anti-slip pad. The base is equivalent to an end cap. The outer diameter of the flexible connecting neck is less than that of the upper seat and the lower seat. Obviously, the structural strength is very weak, and there are major security risks.

In summary, it is necessary to improve the conventional end cap.

SUMMARY OF THE INVENTION

In view of the drawbacks of the prior art, the primary object of the present invention is to provide an end cap structure for a cane/crutch/trekking pole, which can effectively solve the problem that the anti-slip function and the structural strength of the conventional end cap are not good.

In order to achieve the above object, the present invention adopts the following technical solutions:

An end cap structure for a cane/crutch/trekking pole comprises a main body, an elastic interlayer, and a bottom layer. A top end of the main body is recessed with a receiving hole. The elastic interlayer is attached and fixed to an underside of the main body. The bottom layer is attached and fixed to an underside of the elastic interlayer.

Preferably, the elastic interlayer is made of an expanded thermoplastic urethane (ETPU) material. The main body, the elastic interlayer and the bottom layer are superposed and fixed together by bonding.

Preferably, the main body and the elastic interlayer are assembled and positioned with each other through a first protrusion and a first cavity. The elastic interlayer and the bottom layer are assembled and positioned with each other through a second protrusion and a second cavity.

Preferably, an underside of the bottom layer is provided with a convex anti-slip texture.

The present invention has obvious advantages and advantageous effects compared with the prior art. Specifically, it can be known from the above technical solutions:

The elastic interlayer is disposed between the main body and the bottom layer to ensure the structural strength of the end cap. When the user swings the cane/crutch/trekking pole in all directions, the whole underside of the bottom layer is kept in contact with the ground due to the elastic interlayer, so as to ensure that the anti-slip function is not affected, thereby improving the safety of the product when in use and reducing the occurrence of security risks.

DETAILED DESCRIPTION OF THE PREFERRED EMBODIMENTS

Embodiments of the present invention will now be described, by way of example only, with reference to the accompanying drawings.

Figure 1:
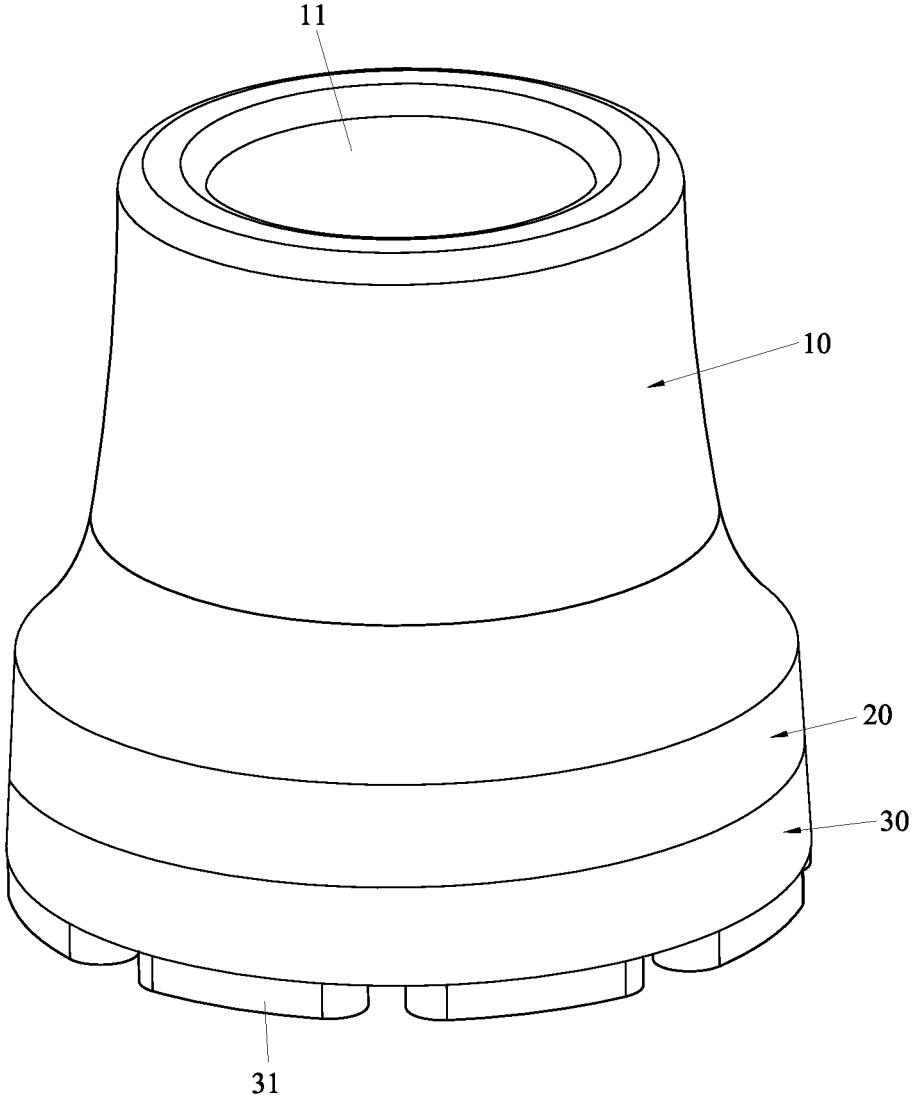
FIG. 1 is a perspective view according to a first embodiment of the present invention.
Figure 2:
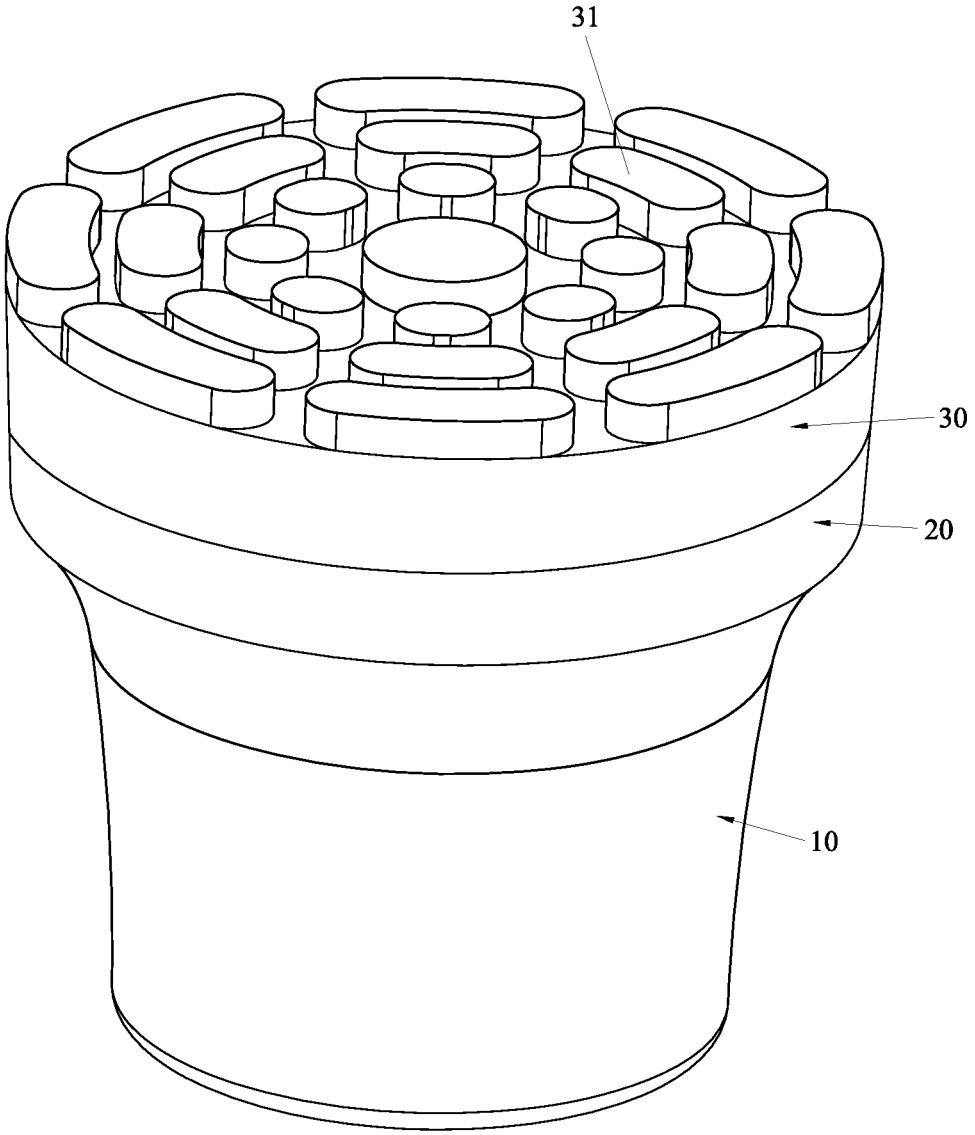
FIG. 2 is another perspective view according to the first embodiment of the present invention.
Figure 3:
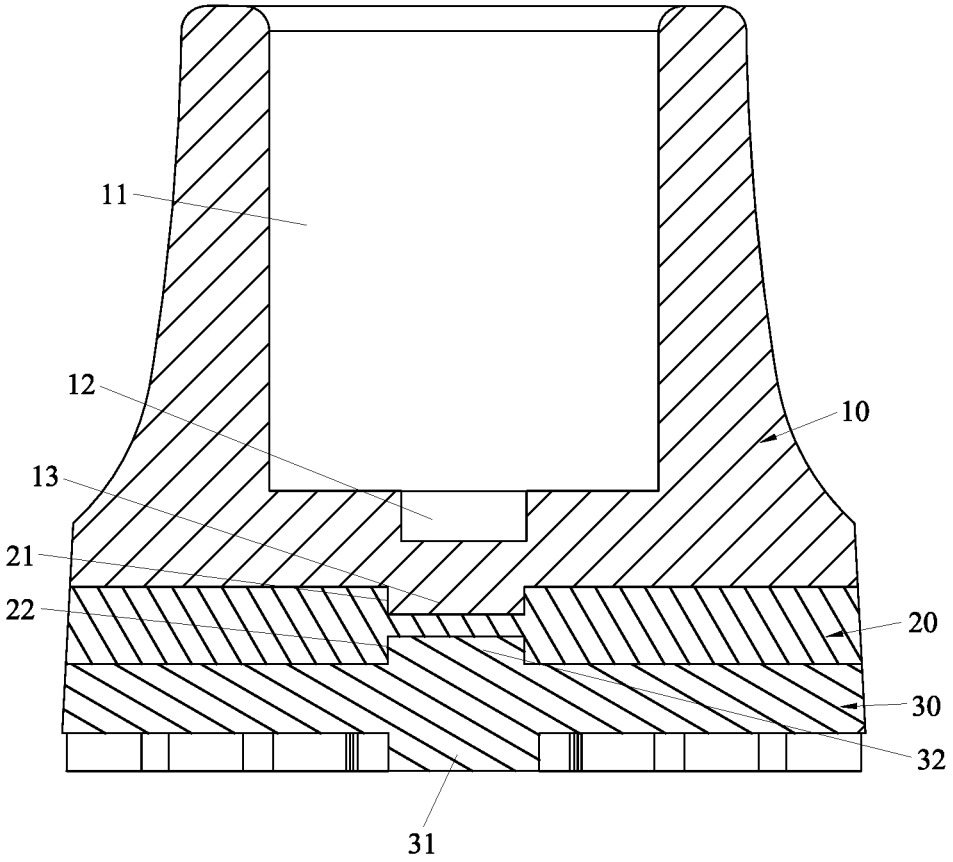
FIG. 3 is a cross-sectional view according to the first embodiment of the present invention.

Referring to FIGS. 1 through 3, a specific structure of a first embodiment of the present invention comprises a main body 10, an elastic interlayer 20, and a bottom layer 30.

The top end of the main body 10 is recessed with a receiving hole 11. In the embodiment, the main body 10 has a truncated cone shape. The inner bottom surface of the receiving hole 11 is concavely provided with a recess 12 to provide a buffer space, so that the connection of the walking cane/crutch/trekking pole and the receiving hole 11 is more stable.

The elastic interlayer 20 is attached and fixed to the underside of the main body 10. The bottom layer 30 is attached and fixed to the underside of the elastic interlayer 20. In this embodiment, both the elastic interlayer 20 and the bottom layer 30 are in the shape of a disk. The outer diameters of the elastic interlayer 20 and the bottom layer 30 are the same as the maximum outer diameter of the main body 10. The underside of the bottom layer 30 is provided with a convex anti-slip texture 31.

The main body 10 and the elastic interlayer 20 are assembled and positioned with each other through a first protrusion 13 and a first cavity 21. The elastic interlayer 20 and the bottom layer 30 are assembled and positioned with each other through a second protrusion 32 and a second cavity 22. In the embodiment, the underside of the main body 10 is provided with the first protrusion 13, the surface of the elastic interlayer 20 is recessed with the first cavity 21, and the first protrusion 13 is embedded in the first cavity 21. In this embodiment, the first protrusion 13 is located at the center of the underside of the main body 10, and the first cavity 21 is located at the center of the surface of the elastic interlayer 20 to function as a positioning, a fulcrum and a connection. Both the height of the first protrusion 13 and the depth of the first cavity 21 are 3 mm. The underside of the elastic interlayer 20 is recessed with the second cavity 22. The surface of the bottom layer 30 is provided with the second protrusion 32. The second protrusion 32 is embedded in the second cavity 22. In this embodiment, the second protrusion 32 is located at the center of the surface of the bottom layer 30, and the second cavity 22 is located at the center of the underside of the elastic interlayer 20 to function as a positioning, a fulcrum and a connection. Both the height of the second protrusion 32 and the depth of the second cavity 22 are 3 mm. The thickness of the elastic interlayer 20 is 8-10 mm.

In addition, both the main body 10 and the bottom layer 30 are made of a thermoplastic elastomer (TPE) material. The elastic interlayer 20 is made of an expanded thermoplastic urethane (ETPU) material. The main body 10, the elastic interlayer 20 and the bottom layer 30 are superposed and fixed together by bonding, thereby achieving a stable connection of the main body 10, the elastic interlayer 20 and the bottom layer 30.

The use of this embodiment is described as follows:

In use, the lower end of the walking cane/crutch/trekking pole is inserted into the receiving hole 11 to be fixed. During the use of the walking cane/crutch/trekking pole, the bottom layer 30 is pressed against the ground, and the whole underside of the bottom layer 30 is in contact with the ground. The user can swing the walking cane/crutch/trekking pole in various directions. Due to the arrangement of the elastic interlayer 20, the whole underside of the bottom layer 30 is kept in contact with the ground, thereby improving the safety of use.

Figure 4:
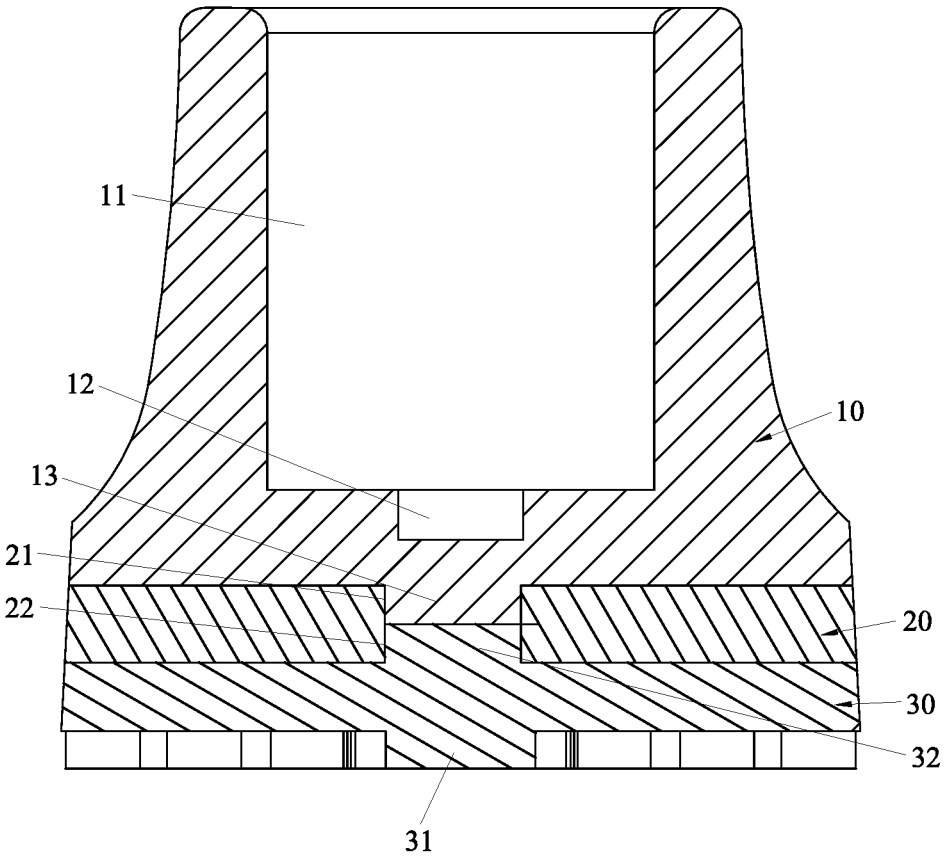
FIG. 4 is a cross-sectional view according to a second embodiment of the present invention.

FIG. 4 shows a specific structure of a second embodiment of the present invention. The specific structure of the second embodiment is substantially similar to the specific structure of the foregoing first embodiment with the exceptions described hereinafter.

In this embodiment, the first cavity 21 communicates with the second cavity 22. The first protrusion 13 and the second protrusion 32 leans against each other to function as a better positioning, a fulcrum and a connection.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An end cap structure for a cane, comprising:

a main body having a top end recessed with a receiving hole and an underside having a center from which a first protrusion integrally extends in an axial direction, the underside of the main body having a bottom planar surface surrounding the first protrusion;

an elastic interlayer having a top attached to the underside of the main body and an underside opposite to the top in the axial direction, wherein the top of the elastic interlayer has a center in which a top cavity is formed and extends in the axial direction to receive the first protrusion of the main body in the axial direction so as to have the elastic interlayer and the main body centered with respect to each other and the underside of the elastic interlayer has a center in which a bottom cavity is formed and extends in the axial direction, the top of the elastic interlayer having a top planar surface surrounding the top cavity of the elastic interlayer, the top planar surface of the elastic interlayer being in direct surface contact engagement with the bottom planar surface of the main body, the underside of the elastic interlayer having a bottom planar surface surrounding the bottom cavity; and a bottom layer having a top attached to the underside of the elastic interlayer, wherein the top of the bottom layer has a center from which a second protrusion integrally extends in the axial direction, the top of the bottom layer having a top planar surface surrounding the second protrusion, the second protrusion of the bottom layer being received in the bottom cavity of the elastic interlayer so as to have the bottom layer and the elastic interlayer centered with respect to each other, the top planar surface of the bottom layer being in direct surface contact engagement with the bottom planar surface of the elastic interlayer, wherein the main body and the first protrusion are integrally formed of a first material; the bottom layer and the second protrusion are integrally formed of the first material; and the elastic interlayer is formed of a second material that is different from the first material, wherein a circumferential portion of the elastic interlayer that surrounds the top and bottom cavities is made of the second material and surrounds a central portion that is formed at least partly of the first and second protrusions made of the first material, and wherein the circumferential portion of the elastic interlayer that is made of the second material is interposed and sandwiched between the bottom planar surface of the main body and the top planar surface of the bottom layer that are made of the first material, and the second material of the elastic interlayer separates the first material of the main body from the first material of the bottom layer, the first and second materials having different elastic properties.

2. The end cap structure according to claim 1, wherein the second material that makes the elastic interlayer comprises an expanded thermoplastic urethane (ETPU) material and the first material that makes the man body and the bottom layer comprises a thermoplastic elastic (TPE) material.

3. The end cap structure according to claim 1, wherein the bottom layer comprises an underside that is opposite to the top of the bottom layer, the underside of the bottom layer being formed with a convex anti-slip texture.

4. The end cap structure according to claim 1, wherein the elastic interlayer has a sidewall contiguous to a sidewall of the main body.

5. The end cap structure according to claim 1, wherein the elastic interlayer has a sidewall contiguous to a sidewall of the bottom layer.

6. The end cap structure according to claim 4, wherein the sidewall of the elastic interlayer is contiguous to a sidewall of the bottom layer.

7. The end cap structure according to claim 1, wherein the elastic interlayer has an outer circumferential surface defining an interlayer outer diameter and the bottom layer has an outer circumferential surface defining a bottom-layer outer diameter, wherein the interlayer outer diameter and the bottom-layer outer diameter are identical to each other and are identical to a maximum outer diameter of the main body defined by an outer circumference of the bottom planar surface of the main body, the outer circumferential surface of the elastic interlayer and the outer circumferential surface of the bottom layer collectively defining a continuous circumferential surface extending from the outer circumference of the bottom planer surface of the main body to an outer circumference of an underside of the bottom layer.

* * * * *